US012359805B1

(12) United States Patent
Vainberg et al.

(10) Patent No.: US 12,359,805 B1
(45) Date of Patent: Jul. 15, 2025

(54) BURNER SYSTEM WITH INTEGRATED SHUTTER AND SPACED APART FILL PORT

(71) Applicant: Solo Brands, LLC, Grapevine, TX (US)

(72) Inventors: Lenny Vainberg, Laguna Hills, CA (US); Alexander K. Maghsadi, Fort Worth, TX (US); Josiah A. Wilhelm, Fort Worth, TX (US); John L. Zivich, Dallas, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/639,335

(22) Filed: Apr. 18, 2024

Related U.S. Application Data

(60) Provisional application No. 63/632,871, filed on Apr. 11, 2024.

(51) Int. Cl.
*F23D 14/46* (2006.01)

(52) U.S. Cl.
CPC ..... *F23D 14/46* (2013.01); *F23D 2202/00* (2013.01); *F23D 2209/00* (2013.01)

(58) Field of Classification Search
CPC ... F23D 14/46; F23D 2202/00; F23D 2209/00
USPC ..... 126/500
See application file for complete search history.

(56) References Cited

U.S. PATENT DOCUMENTS

| | | | | |
|---|---|---|---|---|
| 4,643,164 | A * | 2/1987 | LaForge | F24C 5/18 222/401 |
| D962,403 | S | 8/2022 | Weng | |
| 2006/0134575 | A1 | 6/2006 | Backes | |
| 2012/0298385 | A1* | 11/2012 | Marsala | B60K 15/04 137/511 |
| 2013/0084533 | A1 | 4/2013 | Begg | |
| 2013/0323659 | A1* | 12/2013 | White | F23Q 25/00 431/344 |
| 2017/0176017 | A1 | 6/2017 | Husted | |

FOREIGN PATENT DOCUMENTS

| | | | |
|---|---|---|---|
| CN | 104266259 | A | 1/2015 |
| EP | 3627048 | A1 | 3/2020 |

OTHER PUBLICATIONS

International Searching Authority, International Search Report and Written Opinion of the International Searching Authority, International Application No. PCT/US2025/014459, mld May 20, 2025, 10 pages, ISA/KR.

* cited by examiner

*Primary Examiner* — Vivek K Shirsat
(74) *Attorney, Agent, or Firm* — Haynes and Boone, LLP

(57) ABSTRACT

A burner system comprises a reservoir configured to store fuel, a filler coupled to the reservoir and including a fill port, a burn chamber coupled to the reservoir; and a shutter including a fill cap and a snuffer. The shutter is movable between a burn position wherein the burn chamber is operable to burn fuel stored in the reservoir and a fuel position wherein the fill port is usable to fill the reservoir with fuel.

24 Claims, 10 Drawing Sheets

BURNER SYSTEM WITH INTEGRATED SHUTTER AND SPACED APART FILL PORT

PRIORITY CLAIM

This application claims priority to U.S. Provisional Application No. 63/632,871, filed on Apr. 11, 2024, which is incorporated by reference herein in its entirety.

FIELD

The present disclosure relates to burner systems, and more particularly to liquid-fuel burner systems for a fire feature.

BACKGROUND

Combustion systems (e.g., fireplace burners, tabletop burners) are commonly used to create heat or to create a particular ambiance by burning fuel. The burners burn fuel which has been wicked or evaporated from a reservoir. To fill the reservoir, a user pours a liquid fuel (e.g., ethanol) through the burn chamber and into the reservoir. However, in some instances, it can be difficult to determine whether pre-existing flames are fully extinguished before the pouring occurs. Even when a standalone snuffer is used to extinguish the flames, the snuffer must be removed from the burner to expose the burner before fueling can occur. Therefore, there is a need for a burner system that is simpler and better to use.

SUMMARY

The examples of the disclosure are summarized by the claims that follow the description.

Consistent with some examples, a burner system may comprise a reservoir configured to store fuel, a filler coupled to the reservoir and including a fill port, a burn chamber coupled to the reservoir, and a shutter including a fill cap and a snuffer, the shutter movable between a burn position wherein the burn chamber is operable to burn fuel stored in the reservoir and a fuel position wherein the fill port is usable to fill the reservoir with fuel.

In some examples, in the burn position the burn chamber may be uncovered and the fill cap may cover the fill port of the filler. In the fuel position the fill port may be uncovered and the snuffer may cover the burn chamber.

In some examples, the burner system may further comprise a plug disposed at least partially within the filler, and in the burn position the shutter may prevent the plug from being removed from the filler. The shutter may be an integrated shutter inseparable from the burner system.

In some examples, the burner system may further comprise a base plate positioned above the reservoir, and the shutter may be positioned between the base plate and the burn chamber. The fill cap may be a handle configured to slide through a handle opening defined by the base plate during movement between the burn position and the fuel position. The snuffer may slide against a lip of the burn chamber during movement between the burn position and the fuel position. The fill cap may be a handle including a distally-facing stopping surface engageable with the base plate or the reservoir to prevent distal movement of the shutter beyond the burn position. The snuffer may include a proximally-facing stopping surface engageable with the base plate or the reservoir to prevent proximal movement of the shutter beyond the fuel position.

Consistent with some examples, a method for operating a burner system comprising a reservoir configured to store fuel, a filler coupled to the reservoir and including a fill port, and a burn chamber coupled to the reservoir may comprise moving a shutter including a fill cap and a snuffer between a burn position wherein the burn chamber is operable to burn fuel stored in the reservoir and a fuel position wherein the fill port is usable to fill the reservoir with fuel.

In some examples, moving the shutter between the burn position and the fuel position may include moving the shutter from the burn position to the fuel position, thereby uncovering the burn chamber and covering the fill port of the filler with the fill cap. Moving the shutter between the burn position and the fuel position may include moving the shutter from the fuel position to the burn position, thereby uncovering the fill port and covering the burn chamber with the snuffer.

In some examples, the method may further comprise integrating the shutter with the burner system during assembly of the burner system, and the integrated shutter may be inseparable from the burner system. Assembling the burner system may include positioning a base plate above the reservoir and positioning the shutter between the base plate and the burn chamber.

In some examples, moving the shutter between the burn position and the fuel position may include sliding the fill cap through an opening defined by the base plate. Moving the shutter between the burn position and the fuel position may include sliding the snuffer against a lip of the burn chamber. Moving the shutter between the burn position and the fuel position may include engaging a distally-facing stopping surface of the fill cap with the base plate or the reservoir to prevent distal movement of the shutter beyond the burn position. Moving the shutter between the burn position and the fuel position may include engaging a proximally-facing stopping surface of the shutter with the base plate or the reservoir to prevent proximal movement of the shutter beyond the fuel position.

Consistent with some examples, a burner system may comprise a reservoir configured to store fuel, a filler coupled to the reservoir and usable to fill the reservoir with fuel, the filler including a fill port, and a burn chamber coupled to the reservoir and configured to burn fuel stored in the reservoir, wherein the fill port is spaced apart from the burn chamber.

In some examples, the filler may include a fill line, the fill line configured to introduce fuel into the reservoir through an entrance port in the reservoir, wherein the entrance port is spaced apart from the burn chamber.

In some examples, the burner system may further comprise a shield configured to block heat produced at the burn chamber, wherein the shield is positioned at least partially between the burn chamber and the fill port spaced apart from the burn chamber. The burner system may further comprise a base plate positioned at least partially above the reservoir, the fill port coupled to a fill opening defined by the base plate. The fill opening may be shaped to funnel fuel into the fill port.

In some examples, the filler may include a flame arrester configured to prevent flames from spreading from the burn chamber to the fill port of the filler. The filler may include a one-way valve configured to prevent fuel from flowing from the reservoir towards the fill port.

BRIEF DESCRIPTION OF THE DRAWINGS

The accompanying drawings illustrate examples of systems, devices, and methods disclosed herein and together with the description, serve to explain the principles of the present disclosure.

Figure 1:
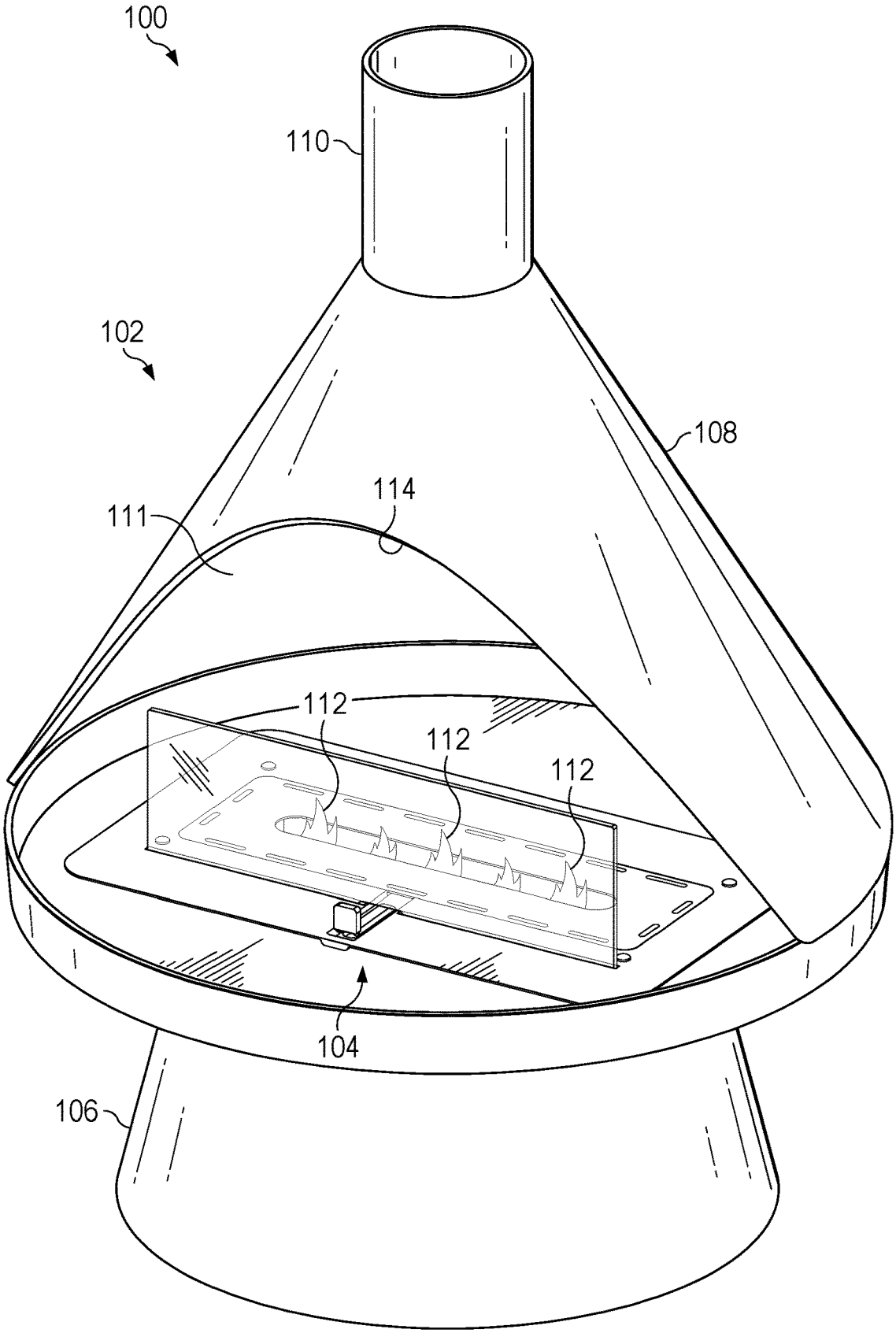
FIG. 1 is a perspective view of a combustion system, according to examples of the present disclosure.

These Figures may be better understood by reference to the following Detailed Description.

DETAILED DESCRIPTION

For the purpose of promoting an understanding of the principles of the present disclosure, reference will now be made to the examples illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other examples or Figures of the present disclosure. For simplicity, in some instances the same or similar reference numbers are used throughout the drawings to refer to the same or like parts.

The present disclosure contemplates a burner system with various advantages. Among other features, the burner system includes a shutter and a filler. In some examples, the shutter is integrated with the burner system. In some examples, the filler includes an isolated fill port. The examples herein may allow port-filling separate and apart from the burn chamber, may simplify product use, enhance user experience, prevent loss or misplacement of components such as a separate snuffer by users, among other advantages.

FIG. 1 shows a combustion system 100. The combustion system 100 includes a frame 102 and a burner system 104. The frame 102 may include a base 106, a body 108, and a vent 110. The components of the burner system 104 will be further described in detail in FIGS. 2-9. The body 108 may sit atop the base 106 and the vent 110 may sit atop the body 108. The base 106 provides structural support for the body 108 using one or more legs. In some examples, no legs are needed and the body 108 sits atop a pre-existing surface such as a table or the ground. The body 108 is configured to hold and support the burner system 104. In some examples, the burner system 104 sits within the body 108 such that a lower portion of the burner system 104 extends within the base 106 and an upper portion of the burner system 104 is exposed within a heated compartment 111 defined by the body 108.

When burning fuel, the burner system 104 produces one or more flames 112 that heat the heated compartment 111. The heated compartment 111 temporarily holds the heat produced by the flames 112 before some heat escapes through either the vent 110 or an opening 114 defined by the body 108. The heat and light that escapes the opening 114 may be used for a variety of purposes including warmth (e.g., convective heat, radiative heat) and ambiance. In some examples, the opening 114 faces the front of the combustion system 100. The vent 110 regulates and manages the heat that is held within the heated compartment 111, by allowing excess heat to escape upwardly. Additionally, the opening 114 and the vent 110 work together to allow oxygen to enter the combustion system 100, promoting continuous combustion.

Figure 2:
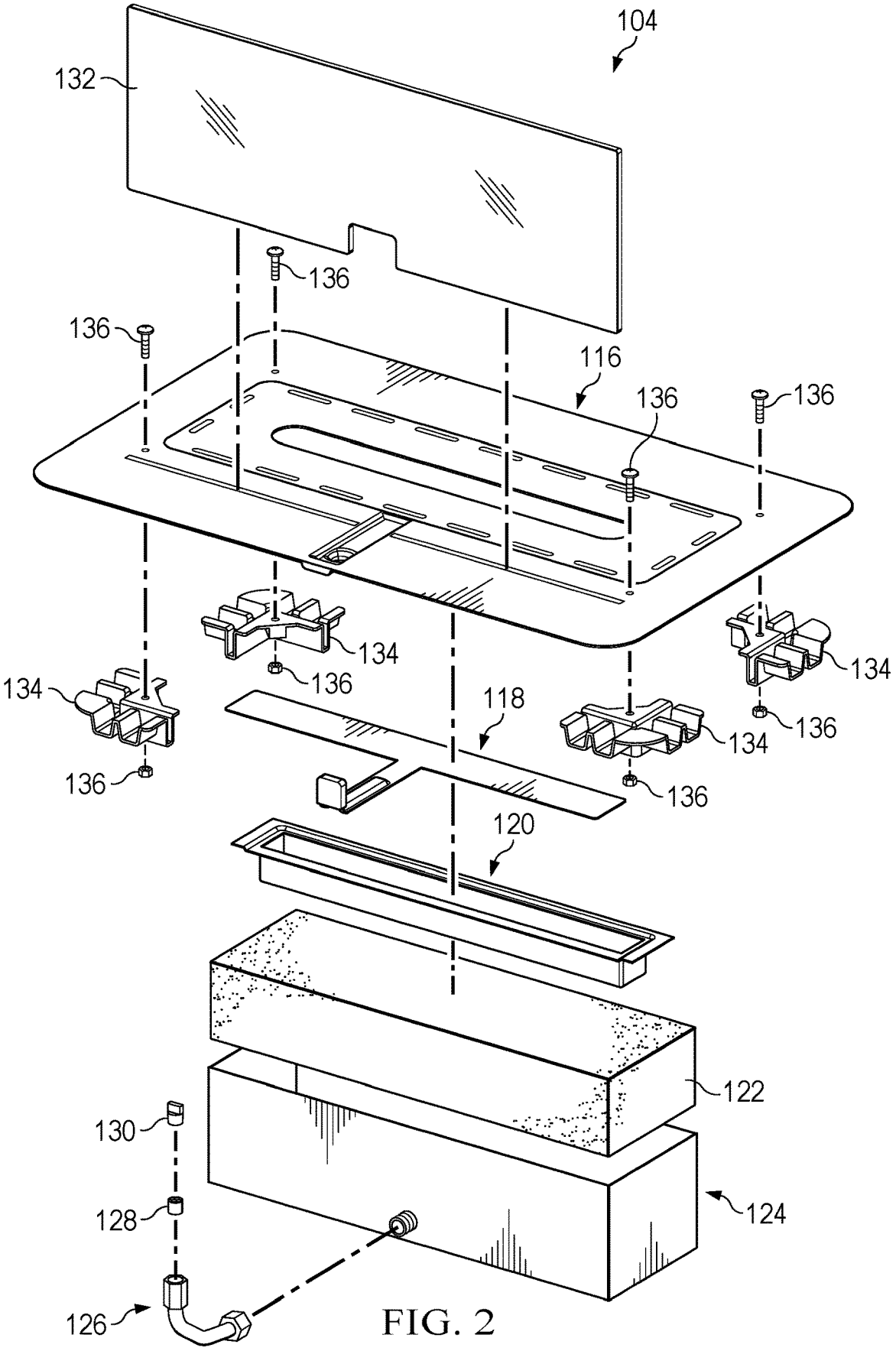
FIG. 2 is an exploded perspective view of a burner system, according to examples of the present disclosure.
Figure 3:
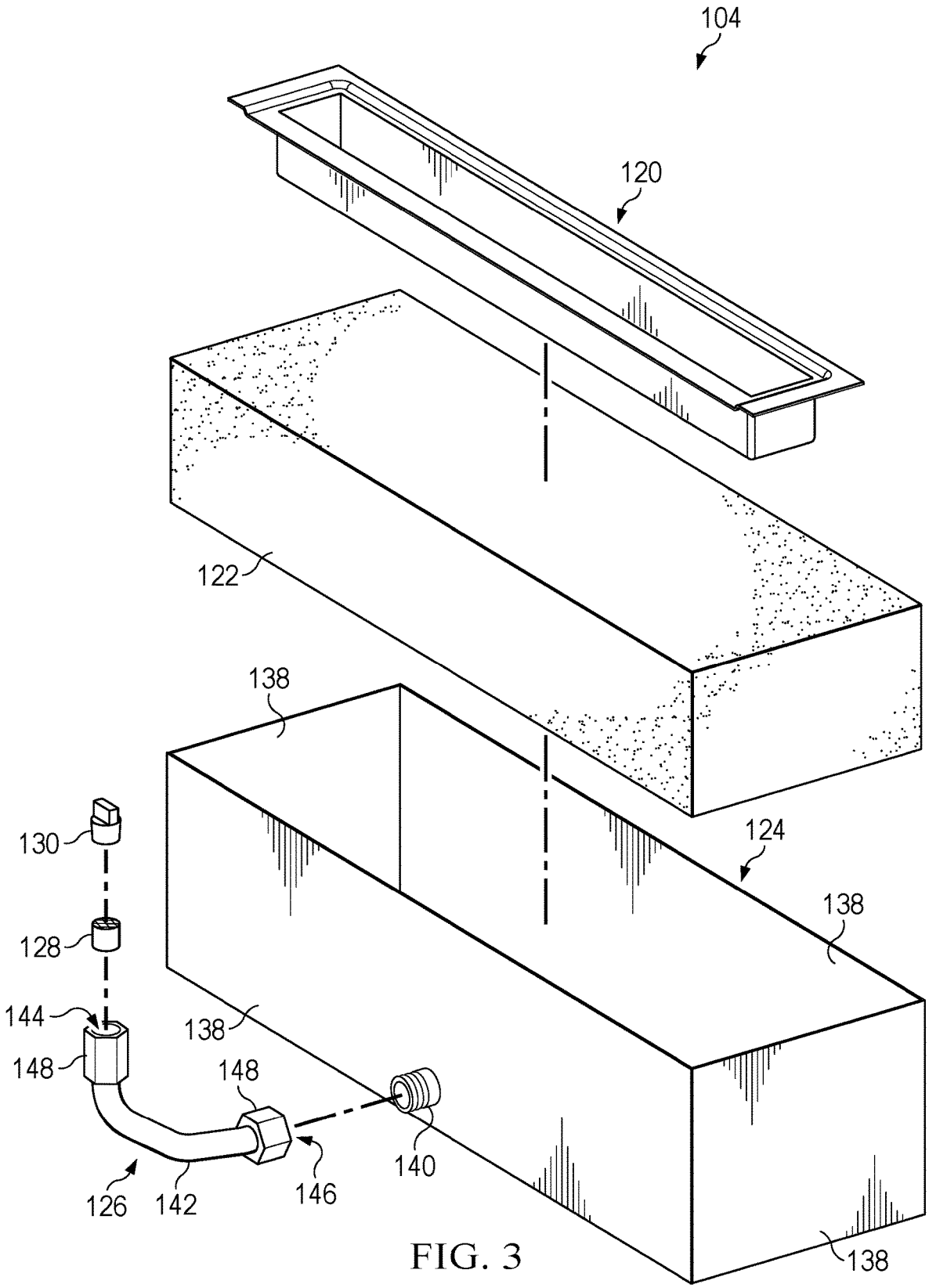
FIG. 3 is an exploded perspective view of portions of a burner system, according to examples of the present disclosure.
Figure 4:
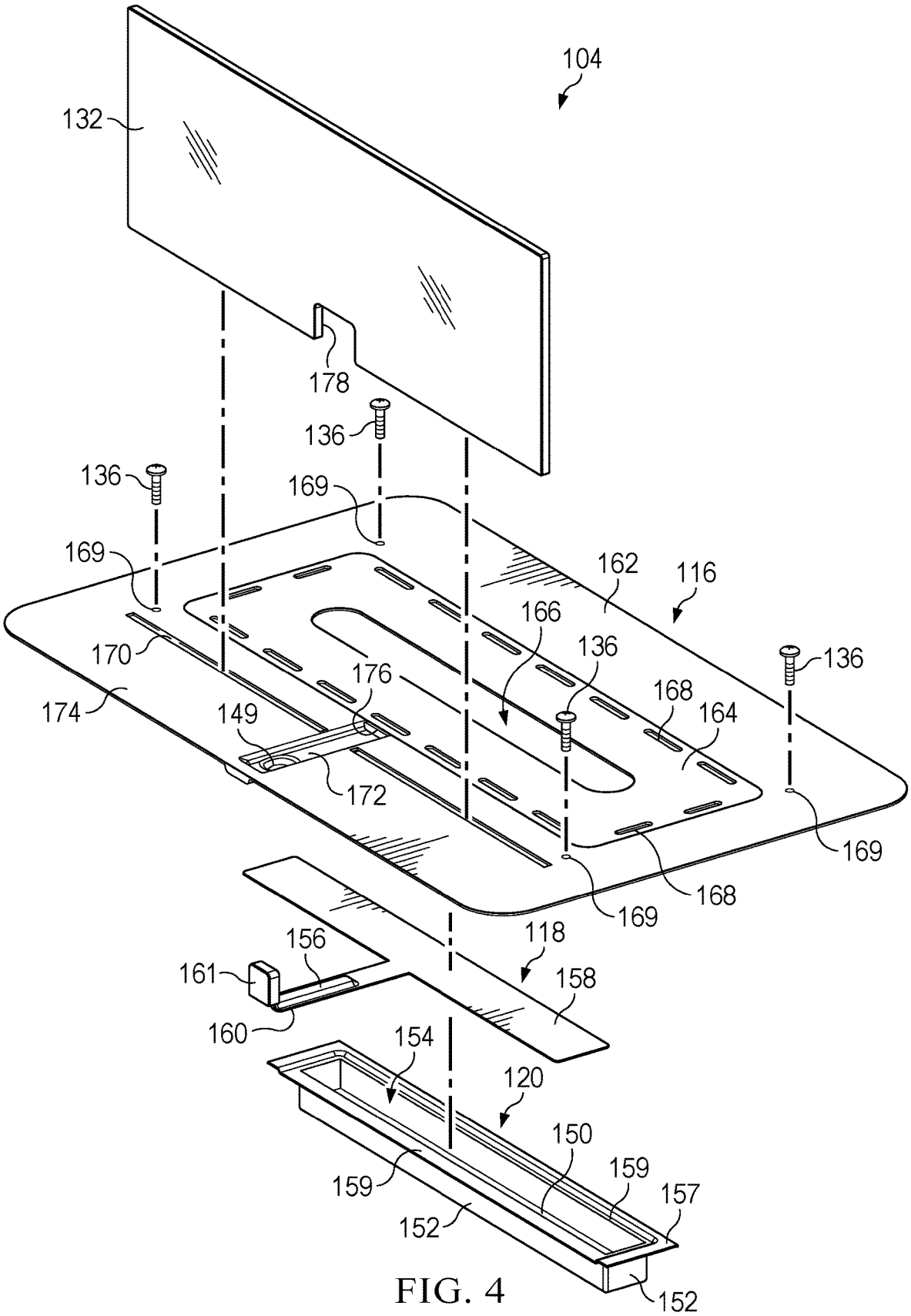
FIG. 4 is an exploded perspective view of portions of a burner system, according to examples of the present disclosure.

FIG. 2 shows components of a burner system (e.g., the burner system 104) exploded outwardly, for illustrative purposes. The burner system 104, in some examples, includes a base plate 116, a shutter 118, a burn chamber 120, a baffle 122, a reservoir 124, a filler 126, a flame arrester 128, a plug 130, a shield 132, supports 134, and fastening components 136, among other components. FIG. 3 is an exploded perspective view showing portions of a burner system (e.g., the burner system 104), according to examples of the present disclosure. Particularly, FIG. 3 shows the burn chamber 120, the baffle 122, the reservoir 124, the filler 126, the flame arrester 128, and the plug 130. FIG. 4 is an exploded perspective view showing portions of a burner system (e.g., the burner system 104), according to examples of the present disclosure. Particularly, FIG. 4 shows the burn chamber 120, the shutter 118, the base plate 116, and the shield 132. All of these components will now be described with reference to FIGS. 2-4.

The reservoir 124 is configured to store and hold fuel. For example, the reservoir 124 may store ethanol or other types of fuel such as natural gas, propane, diesel, heating oil, biofuels, coal, and solid waste, among other examples. The reservoir 124 may act as a foundation for the burner system 104 and may support the other components. For example, as shown in FIG. 2, the other components of the burner system 104 are positioned atop the reservoir 124. Although the reservoir 124 is shown as rectangular, the reservoir 124 may be of any shape or size. The reservoir 124 may be made of a variety of materials including metals and other heat resistant materials.

The reservoir 124 includes a bottom 137 (see FIGS. 7 and 8) and a plurality of vertically extending sidewalls 138. In some examples, the reservoir 124 may open at the top to accommodate the baffle 122 and the burn chamber 120. The reservoir 124 may include an entrance port 140 used to introduce fuel into the reservoir 124. The entrance port 140 may be positioned one or more of the sidewalls 138. The entrance port 140 may be threaded to mate with threads on the filler 126.

In some examples, fuel is introduced into the reservoir 124 through the entrance port 140 directly without the use of the filler 126. In other examples, as shown in FIG. 4, fuel is introduced into the entrance port 140 via the filler 126 coupled to the reservoir 124. When the filler 126 is coupled to the reservoir 124 via the entrance port 140 it may be beneficial for the entrance port 140 to be located on a bottom portion of the sidewall 138 such that the entrance port 140 is vertically below the burn chamber 120. A low entrance port 140 can utilize gravitational forces to encourage fuel to flow from the filler 126 into the entrance port 140. It is understood that in some examples, the filler 126 may be draped or hung into the top of the reservoir 124, and there may be no entrance port 140.

The filler 126 is usable to fill the reservoir 124 with fuel. The filler 126 may be curved and made of a variety of materials for example, including various metals and plastics. In some examples, the filler 126 may be plugged by the plug 130 to prevent fuel from entering or otherwise traveling through the filler 126 and into the reservoir 124. The filler 126 may also include a flame arrester 128 disposed therein to prevent the propagation of the flames 112 from the reservoir 124 through the filler 126. The flame arrester 128 may be made of metal or other heat-resistant materials. The fillers described herein provide a plurality of advantages, which will be described in further detail below, including a spaced apart fill port.

As shown in FIG. 3, the filler 126 may be coupled to the reservoir 124. The filler 126 includes a fill line 142, a fill port 144, and an exit port 146. The fill port 144 is usable to fill the reservoir 124 with fuel. Fuel poured or otherwise inserted through the fill port 144 may travel inside the fill line 142 and out the exit port 146 to enter the reservoir 124 via the entrance port 140.

The filler 126 may include fastening members 148 positioned near the fill port 144 and the exit port 146. The fastening members 148 may be integrated with the fill line 142 or may be couplable to the fill line 142. The fastening members 148 are configured to secure the filler 126 to the reservoir 124 and/or the base plate 116. In this way, the fastening members 148 may secure the filler 126 using press-fit or other fastening techniques. In some examples, one of the fastening members 148 on the filler 126 is press-fit into or onto the entrance port 140 protruding from the reservoir 124. In other examples, the fastening members 148 are coupling nuts having internal and/or external threads engageable with corresponding threads on the entrance port 140.

The filler 126, in some examples, houses the flame arrester 128. The flame arrester 128 is configured to prevent the flames 112 from spreading from the burn chamber 120 to the fill port 144 of the filler 126. In some examples, the flame arrester 128 is disposed within the fill port 144, while in other examples the flame arrester 128 may be disposed in the fill line 142, the exit port 146, or the fastening members 148. In yet other examples, the flame arrester 128 may be located in the entrance port 140 to the reservoir 124.

The filler 126, in some examples, may also house the plug 130. The plug 130 can be disposed at least partially within the filler 126. In this example, the plug 130 is at least partially within the fill port 144. The plug 130 functions to allow and deny access to the fill port 144. A user can unplug the fill port 144 before pouring fuel into the fill port 144 to fill the reservoir 124. As will be described further below, the slidable position of the shutter 118 may deny access to the plug 130 in some situations, for example, when the flames 112 are burning and exposed. The plug 130 may be made of a variety of materials including metals and polymers, among others. When the plug 130 is a flexible rubber, the plug 130 press-fits into the fill port 144, the fastening member 148, or a fill opening 149 (see FIG. 4) defined by the base plate 116.

The filler 126, in some examples, may also house a valve 151 (see FIGS. 7-9) configured to prevent fuel from flowing from the reservoir 124 towards the fill port 144. The valve 151 may be a one-way valve or flap housed within the fill line 142 or other portions of the filler 126. In this way, the valve 151 functions to ensure that any fuel introduced into the system, despite fluctuating pressures in the system, flows towards the reservoir 124 and does not flow back out the fill port 144.

The baffle 122 is used in some examples to improve combustion efficiency, enhance heat transfer, prevent heat loss, stabilize flames, and/or reduce emissions. The baffle 122 may be placed within the reservoir 124 to control the flow of the air and gases therein such as fuel and oxygen. This promotes efficient mixing of the fuel and air, leading to cleaner and more complete combustion. Another benefit of the baffle 122 to the burner system 104 is its ability to stabilize the flames 112 produced thereby by controlling airflow patterns and reducing the likelihood of flame lift-off or oscillation. Furthermore, the baffle 122 may prevent excessive movement and sloshing of any fuel stored within the reservoir 124 when the burner system 104 is moved.

The burn chamber 120 serves as the primary combustion area where fuel is burned to produce heat and the flames 112. The burn chamber 120 may be coupled to the reservoir 124. In some examples, the burn chamber 120 is capable of producing the flames 112 without emitting smoke, soot, or harmful fumes, making the burner system 104 suitable for indoor or outdoor use. When the burn chamber 120 burns the fuel stored in the reservoir 124, the heat produced radiates outward, warming the surrounding area. Furthermore, the burn chamber 120 may be configured to contain the flames 112 produced by burning the fuel. The burn chamber 120 may be shaped and configured such that the flames 112 dance and flicker within the burn chamber 120, creating an aesthetically pleasing visual display. The burn chamber 120 may be made of a variety of materials including metals such as metals including stainless steel, tempered glass, or ceramic, among other materials. The burn chamber 120 is configured to contain the flames 112 produced during burning and to prevent direct contact with the burning fuel, reducing the risk of accidental burns or spills. In that regard, the burn chamber 120 may be recessed within the reservoir 124, as discussed further throughout this disclosure.

Like the reservoir 124, the burn chamber 120 may have a bottom 150 and a plurality of vertically extending sidewalls 152. The bottom 150 may be perforated with a plurality of holes to couple the burn chamber 120 to the reservoir 124 fluidically. The holes in the bottom 150 of the burn chamber 120 allow fuel, the flames 112, and oxygen to pass between the reservoir 124, the burn chamber 120, and the environment. The size of the plurality of holes may control the size of the flames 112 produced.

The burn chamber 120 is open on at least one side, a top, or a bottom to define a burn opening 154. In the example shown, the burn opening 154 is defined in the top of the burn chamber 120. The burn opening 154 allows the oxygen to enter and the flames 112 and heat to escape the burn chamber 120. The burn chamber 120 is shown as being rectangular, however, the burn chamber 120 may be of any shape. The shape of the burn chamber 120 may be altered based on the desired shape of the flames 112 and the overall shape of the burner system 104. In some examples, there are multiple burn chambers 120 and the burn chambers 120 may be round.

Figure 7:
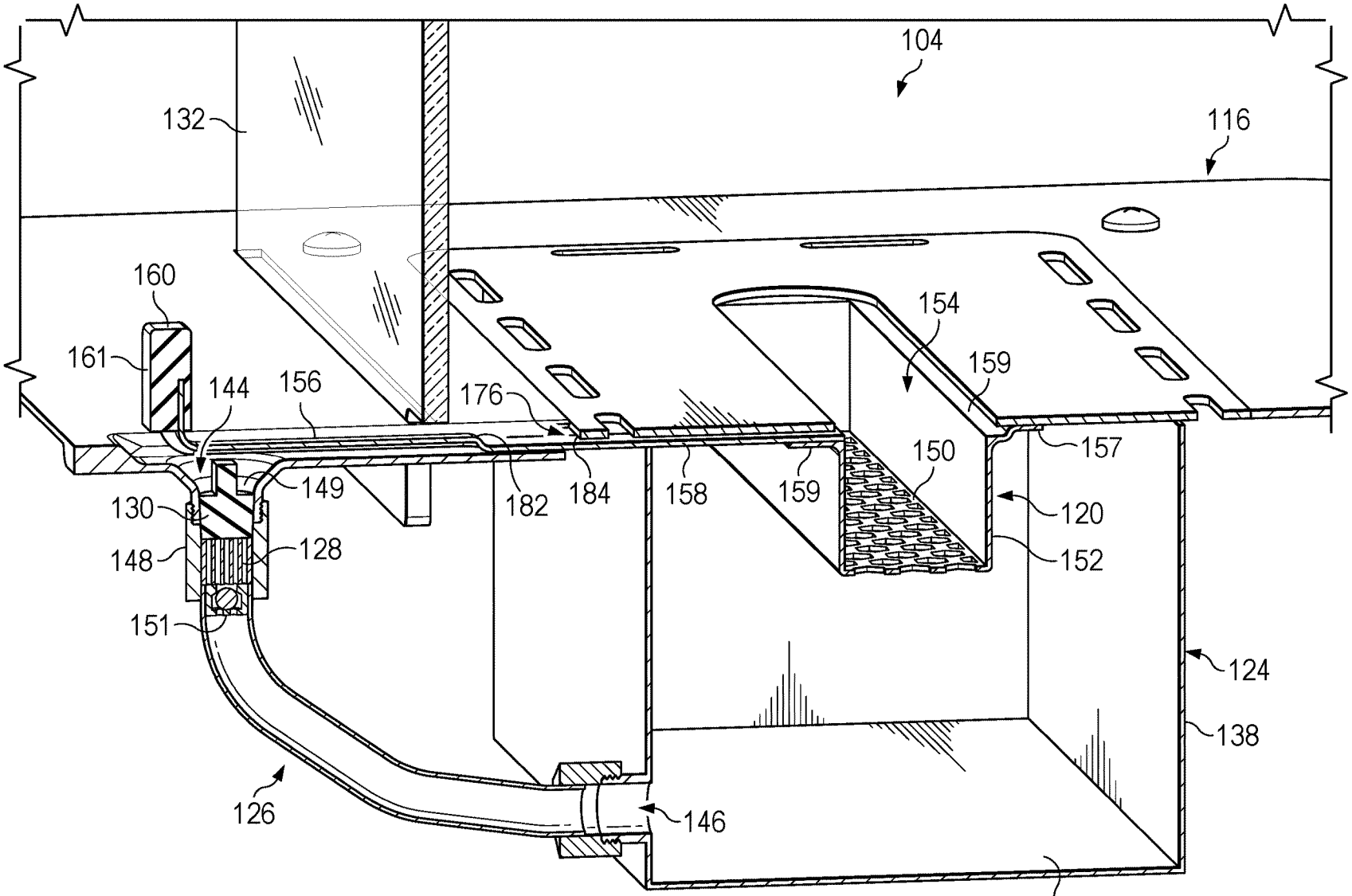
FIG. 7 is a perspective cross-section of a burner system, according to examples of the present disclosure.
Figure 8:
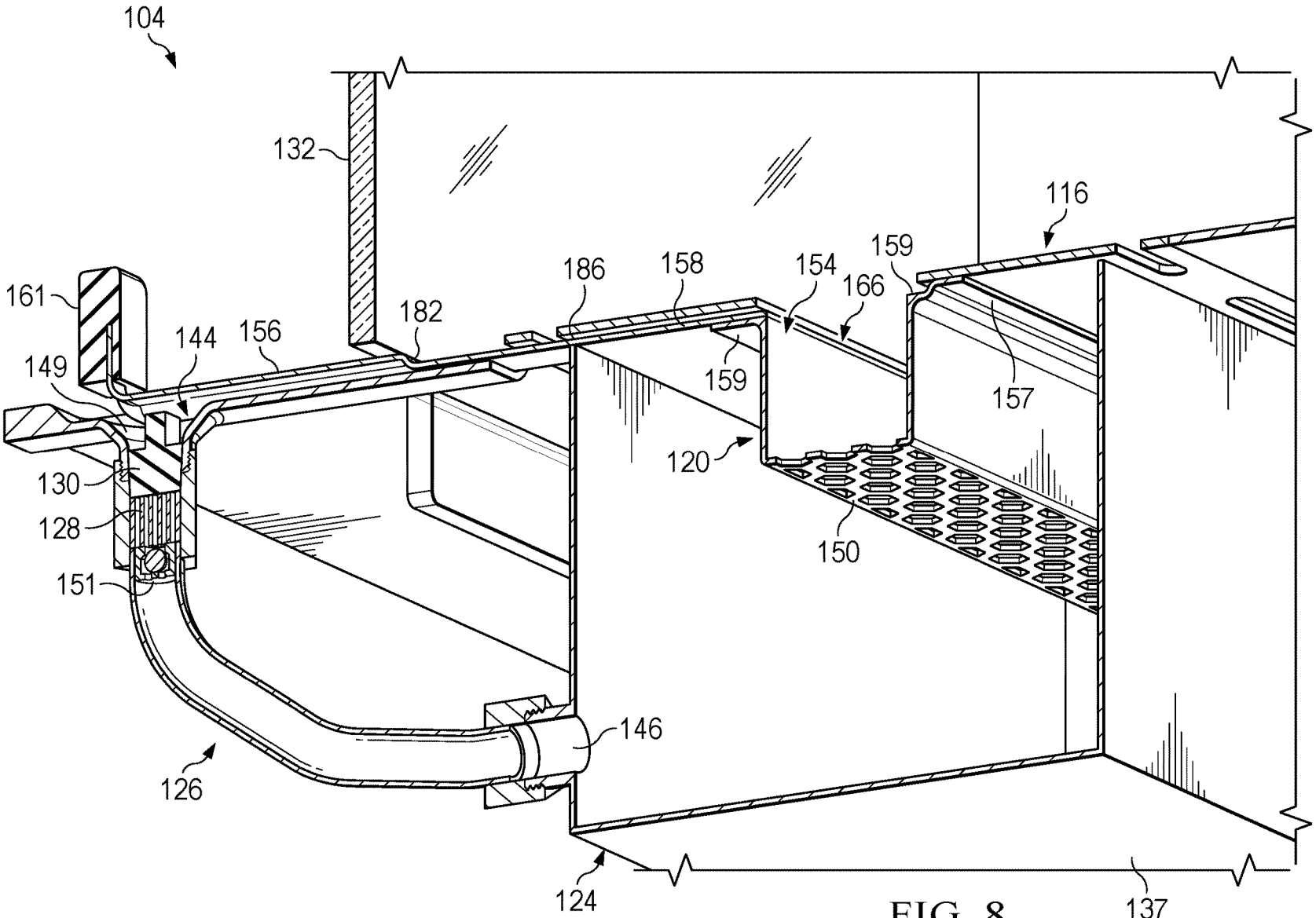
FIG. 8 is a perspective cross-section of a burner system, according to examples of the present disclosure.
Figure 9:
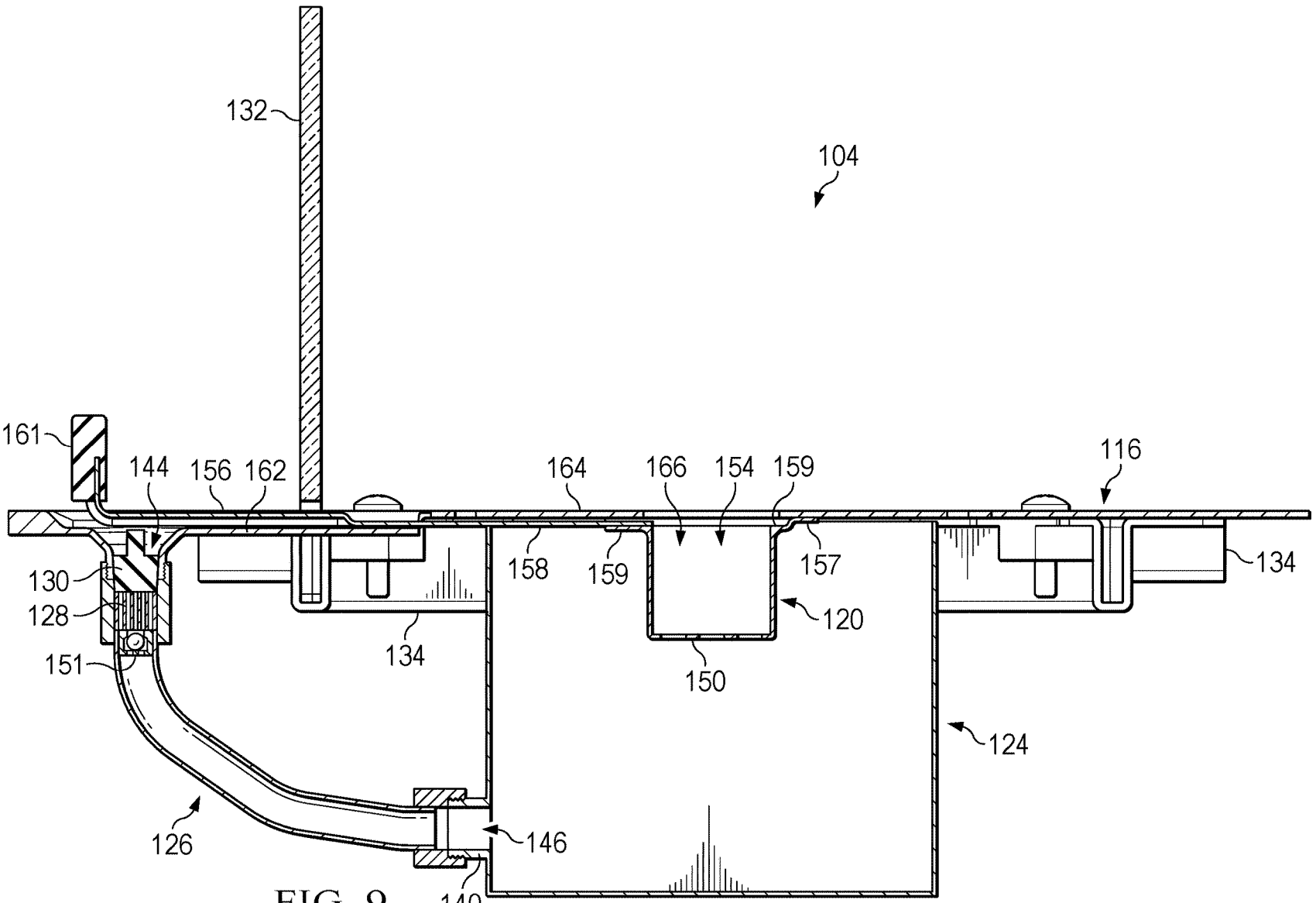
FIG. 9 is a side cross-section of a burner system, according to examples of the present disclosure.

The burn chamber 120 is shown recessed or otherwise suspended within the reservoir 124 (e.g., see FIGS. 7-9). The burn chamber 120 can include a flange 157 extending in a plurality of directions laterally away from the burn chamber 120. The flange 157 may rest upon a surface of the base plate 116 or a surface of the reservoir 124, thereby suspending the burn chamber 120. In some examples, the flange 157 may be welded to either the base plate 116 or the reservoir 124 to secure the burn chamber 120 between the two. By suspending the burn chamber 120 within the reservoir 124, the burn chamber 120 contains the flames 112 except in the upward direction. Additionally, suspending the burn chamber 120 protects the combustion region from inconsistent environmental conditions such as wind. The burn chamber 120 may also define a lip 159 configured to guide the shutter 118 during sliding movement. Specific features of the lip 159 will be discussed further below with respect to FIG. 7.

The shutter 118 may serve to snuff the combustion occurring within the burn chamber 120. The shutter 118 may also serve to allow and prevent fuel from entering the filler 126. In some examples, the shutter 118 is an integrated shutter that is inseparable from the burner system 104 when the burner system 104 is assembled. The shutter 118 may be positioned between the base plate 116 and the burn chamber 120. The shutters described herein provide a plurality of advantages, which will be described in further detail below, including integrated and dual-purpose shutters.

The shutter 118, in some examples, includes a handle 156 and a snuffer 158. As will be described further below with respect to FIGS. 5 and 6, the shutter 118 is movable between a burn position where the burn chamber 120 is operable to burn fuel stored in the reservoir 124 and a fuel position where the fill port 144 is usable to fill the reservoir 124 with the fuel. The handle 156 is graspable by a user to move the shutter 118 between the burn position and the fuel position. In some examples, the handle 156 may include or be shaped to include a tab 160 located on a proximal end of the handle 156. The tab 160 makes it easier for a user to grasp the handle 156 to push and pull the shutter 118 between the burn position and the fuel position. The tab 160 may be covered by a grip 161. The grip 161 may be made of heat-resistant materials to ensure that the handle 156 is safe to handle. The grip 161 may also be a material which is soft and with a high coefficient of friction such as a rubber or another polymer. In some implementations, the handle 156 functions as a fill cap that may be grasped or not grasped by a user. In some implementations, a fill cap is included on the handle 156. In some implementations a fill cap is included on the shutter 118 separate from the handle 156 or the fill cap is separate from the shutter 118 and can be manipulated by movement of the shutter 118.

The base plate 116 serves as a foundation and/or a platform to which the other components of the burner system 104 can be mounted or otherwise attached. The base plate 116 is positioned atop the reservoir 124. The base plate 116 facilitates the assembling and fastening of many of the components of the burner system 104 together. The base plate 116 may be made of strong and durable heat-resistant materials such as stainless steel, aluminum, or heat-resistant composites. Materials such as these are capable of withstanding the high temperatures generated by the combustion occurring in the burn chamber 120. Depending on the type of combustion system 100 that the burner system 104 is used in, the base plate 116 may serve to protect surfaces such as tabletops or the ground from the high temperatures produced in the burn chamber 120 and radiated outwards.

The base plate 116, in some examples, includes an outer plate 162 and an inner plate 164. The outer plate 162 and the inner plate 164 may be made from a single sheet of material or may be a plurality of pieces coupled together. In some examples, the inner plate 164 is made of a material with a higher heat resistance than the outer plate 162.

The inner plate 164 defines a burn opening 166. The burn opening 166 in the base plate 116 aligns with the burn opening 154 of the burn chamber 120. The inner plate 164 may also include a plurality of holes 168 that dissipate heat from the burner system 104. In some examples, the shape of the inner plate 164 corresponds to the shape of the reservoir 124. In this way, the inner plate 164 may be stacked above the reservoir 124.

The outer plate 162 projects laterally outward from the inner plate 164. The outer plate 162 serves a variety of functions. The outer plate 162 may include a plurality of fastening holes 169 configured to receive the fastening components 136. The outer plate 162 may also include a slit 170 or a plurality of slits 170 configured to receive the shield(s) 132. The outer plate 162 may also include a slot 172 configured to house the handle 156 of the shutter 118. The slot 172 may be recessed from a top surface 174 of the base plate 116 so that the handle 156 sits below the top surface 174.

In some examples, the base plate 116 defines a handle opening 176. The handle 156 of the shutter 118 can slide along the slot 172 and through the handle opening 176 during movement of the shutter 118 between the burn position and the fuel position. In some examples, the handle opening 176 is defined by the inner plate 164. In other examples, the handle opening 176 is defined by the outer plate 162. In yet other examples, the handle opening 176 is defined between the inner plate 164 and the outer plate 162.

The shield 132 serves to reduce the risk of accidental burns. The shield 132 creates a physical barrier between the flame and anyone nearby, decreasing the chance of direct contact with the hot burner assembly. The shield 132 may be positioned at least partially between the burn chamber 120 and the fill port 144. The shield 132 is configured to block heat produced at the burn chamber 120. Furthermore, the shield 132 may help to block the burn chamber 120 and the flames 112 produced therethrough from wind or other environmental presences such as rain. In some examples, the shield 132 is positioned on a single side as shown. In other examples, the shield 132 may be positioned on a plurality of sides of the burn chamber 120 or may be curved to at least partially surround the flames 112. The shield 132 may be shaped to include a cutout 178 so that the shield 132 can stand and be held within the slit 170. The cutout 178 also provides clearance so that the shutter 118 can slide back and forth between the burn and fuel positions. It is understood that the shield 132 may be adhered or coupled to the burner system 104 in other ways. The shield 132 may be made of a variety of materials including glass, plastic, metal, or other heat-resistant materials. The shield 132 may be translucent or transparent.

Figure 5:
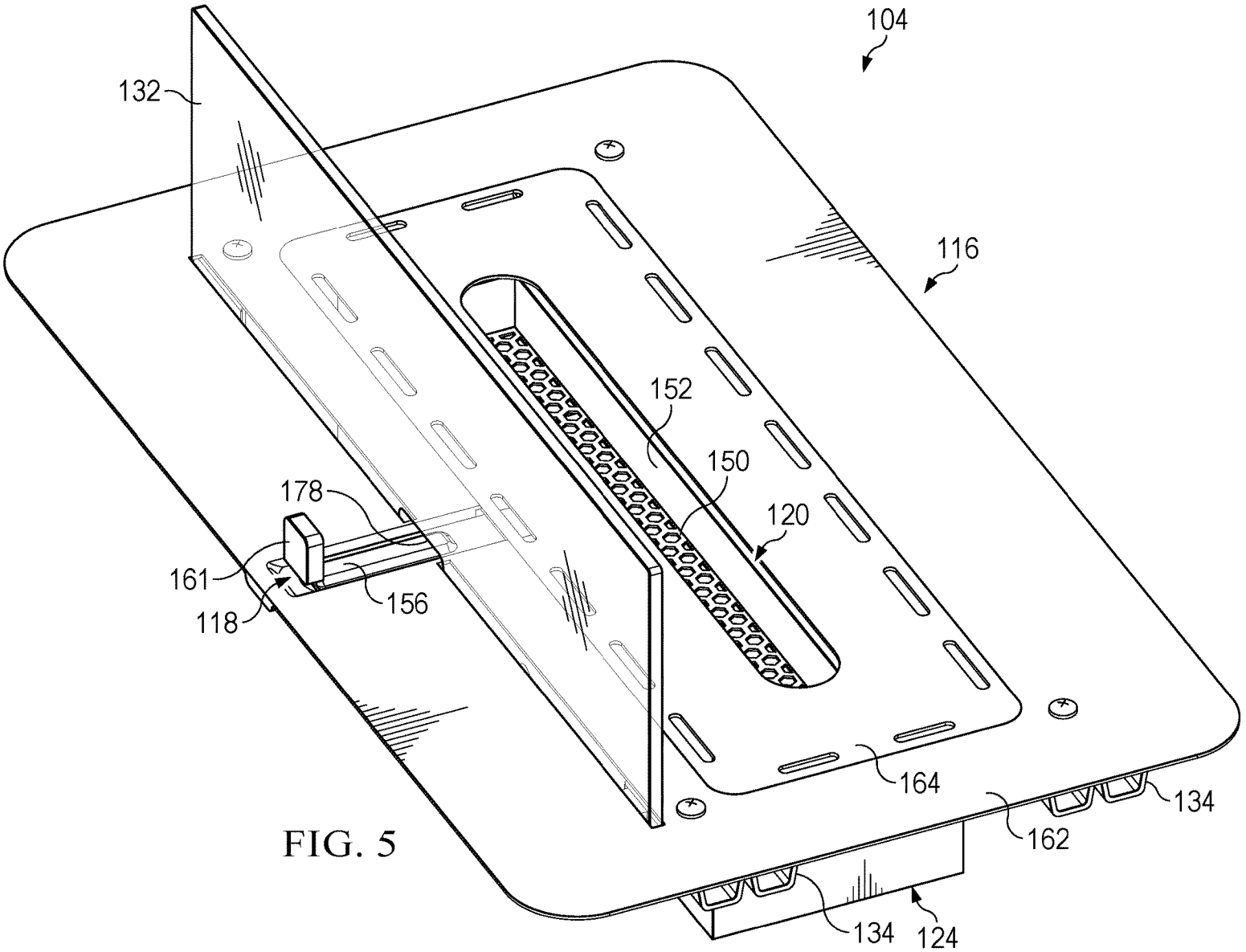
FIG. 5 is a perspective view of a burner system in a burning position, according to examples of the present disclosure.

FIG. 5 is a perspective view of a burner system (e.g., the burner system 104) in a burn position, according to examples of the present disclosure. In this example, the shutter 118 is in the burn position. Accordingly, the burn chamber 120 is operable to burn fuel stored in the reservoir 124. In this way, the burn chamber 120 is uncovered because the snuffer 158 is retracted and positioned beneath the inner plate 164 of the base plate 116. Additionally, the handle 156 of the shutter 118 is retracted proximally such that it covers the fill port 144 of the filler 126. In examples where the plug 130 is included, the shutter 118, in the burn position, prevents the plug 130 from being removed from the filler 126.

When in the burn position, the burner system 104 can burn the fuel in the reservoir 124, but fuel cannot be introduced into the reservoir 124. The shutter 118 serves multiple functions simultaneously by exposing the burn chamber 120 to allow combustion while also covering the fill port 144 of the filler 126 to prevent fueling. By covering the filler 126, the shutter 118 ensures that fuel cannot be introduced into the burner system 104 while the burner system 104 is actively combusting fuel.

Figure 6:
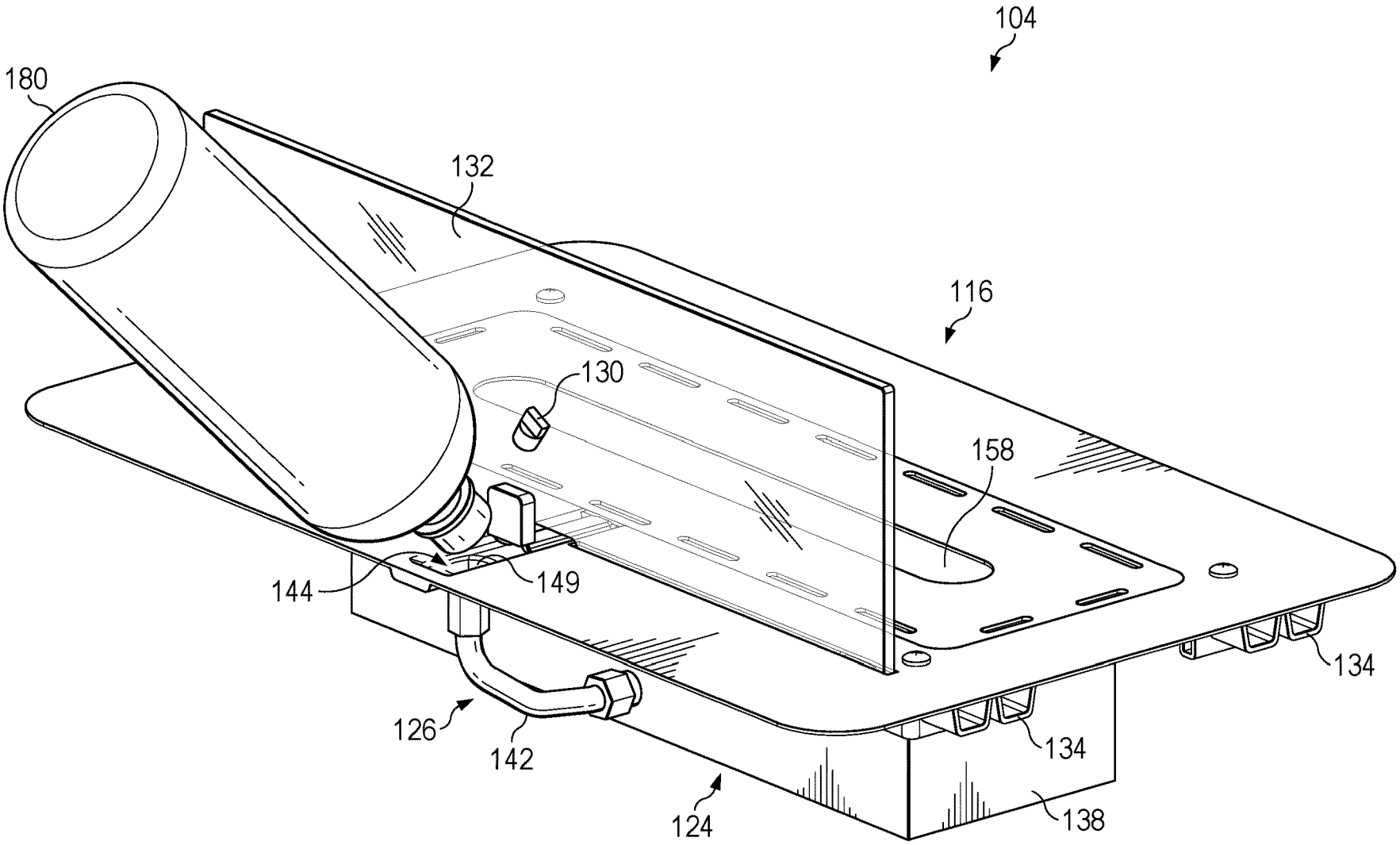
FIG. 6 is a perspective view of a burner system in a fueling position, according to examples of the present disclosure.

FIG. 6 is a perspective view of a burner system (e.g., the burner system 104) in a fuel position, according to examples of the present disclosure. In this example, the shutter 118 is in the fuel position. FIG. 6 shows the plug 130 removed from the filler 126 after the shutter 118 entered the fuel position. A fuel bottle 180 is pouring fuel into the fill port 144. The fuel travels through the fill line 142, out the exit port 146, and into the entrance port 140 to the reservoir 124.

When in the fuel position, the fill port 144 is usable to fill the reservoir 124 with fuel. In this way, the handle 156 is extended such that the fill port 144 is uncovered and the snuffer 158 is extended such that the burn chamber 120 is covered. In examples where the plug 130 is included, the shutter 118, in the fuel position, allows the plug 130 to be removed from the filler 126.

When in the fuel position, the burner system 104 cannot burn the fuel in the reservoir 124 but can introduce additional fuel into the reservoir 124. The shutter 118 serves multiple functions simultaneously by covering the burn chamber 120 to prevent combustion while also uncovering the fill port 144 of the filler 126 to allow fueling. By covering the burn chamber 120 while the filler 126 is uncovered, the shutter 118 ensures that the burner system 104 cannot combust fuel while fuel is being added. This prevents the flames 112 from spreading through the fuel towards the user.

FIGS. 7 and 8 are perspective cross-sections of a burner system (e.g., the burner system 104), according to examples of the present disclosure. FIG. 9 is a side cross-section of a burner system (e.g., the burner system 104), according to examples of the present disclosure. In the examples shown in FIGS. 7-9, the burner system 104 has been assembled.

The shutter 118 is an integrated shutter that is inseparable from the burner system 104. Because the shutter 118 is integrated, the shutter 118 cannot be removed easily by a user. In some examples, disassembly of the burner system 104 or of the shutter 118 itself is required to disintegrate the shutter 118 from the burner system 104. It is advantageous that the shutter 118 be integrated with the burner system 104. The ability for the shutter 118 to serve as a dual-purpose shutter without being separated from the system may allow port-filling separate and apart from the burn chamber, may simplify product use, enhance user experience, prevent loss or misplacement of the shutter 118, among other advantages.

It is understood that the shutter 118 can be integrated in a variety of different ways. In some examples, as shown, the shutter 118 extends through the handle opening 176. The shutter 118 can slide within the handle opening 176 between the burn and fuel positions. Because the shutter 118 is integrated, it is difficult or impossible to remove the shutter 118 out of the slot 172 defined by the base plate 116.

If a user attempts to move the shutter 118 distally beyond the burn position, a distally-facing stopping surface 182 of the handle 156 engages a surface 184 of the base plate 116 or the reservoir 124. The engagement of the handle 156 with the base plate 116 prevents distal movement of the shutter 118 beyond the burn position and also prevents removal of the shutter 118 from the burner system 104. The distally-facing stopping surface 182 may be defined by the shape or curvature of the handle 156. In other examples, the distally-facing stopping surface 182 can be a projection extending from or coupled to the handle 156.

If a user attempts to move the shutter 118 proximally from the fuel position, a proximally-facing stopping surface 186 of the shutter 118 engages the reservoir 124 or the base plate 116. The proximally-facing stopping surface 186 of the snuffer 158 may be formed by the shape or curvature of the snuffer 158. In other examples, the proximally-facing stopping surface 186 is on a projection, protrusion, or boss that extends vertically below the central shaft of the shutter 118. In some examples, the snuffer 158 engages a surface of the base plate 116 at the handle opening 176 when the snuffer 158 is wider than the handle opening 176. The engagement of the shutter 118 and the base plate 116 prevent proximal movement of the shutter 118 from the fuel position and also prevents removal of the shutter 118 from the burner system 104.

FIGS. 7-9 show the shutter 118 in a burn position, where the handle 156 is covering the fill port 144 and the burn chamber 120 is exposed. To move the shutter 118 from the burn position to the fuel position or from the fuel position to the burn position a user can slide the handle 156 proximally or distally through the handle opening 176 defined by the base plate 116. As the user pushes or pulls on the handle 156, the snuffer 158 slides against the lip 159 of the burn chamber 120. The lip 159 acts as a guide for the snuffer 158.

Another advantageous feature of the burner system 104 is that the entrance port 140 is spaced apart from the burn chamber 120. Because the entrance port 140 is spaced apart from the burn chamber 120, a user does not need to introduce fuel into the reservoir 124 through the burn chamber 120. Introducing fuel in into the burn chamber 120 poses a risk of pouring fuel onto a lit flame. Furthermore, because the entrance port 140 is separate and spaced apart from the burn chamber 120, the user may add fuel to the burner system 104 while the burner system 104 is snuffed. Accordingly, the entrance port 140 spaced apart from the burn chamber 120 simplifies product use and enhances user experience.

Similarly, it is advantageous that the fill port 144 be spaced apart from the burn chamber 120. Spacing the fill port 144 from the burn chamber 120 increases the distance between any potentially active flames and where the user insert fuel into the burner system 104. In this example, the fill port 144 is coupled to the fill opening 149 defined by the base plate 116. This give structural rigidity to filler 126 and the fill opening 149 serves as a fixed location where the shutter 118 can selectively cover the fill port 144. As shown, the fill opening 149 may be configured and shaped to funnel fuel into the fill port 144. Because the fill opening 149 is shaped like a funnel, the area by which the user can pour the fuel is increased. Additionally, the funneled fill opening 149 allows for the plug 130 to be press-fit within the fill opening 149.

Although the FIGS. show the shutter 118 in either a burn position or a fuel position, it is understood that the shutter 118 can be controlled by a user so that the shutter 118 covers a portion of the opening 154 of the burn chamber 120. As such, the shutter 118 can be used to tame or minimize the combustion occurring in the burn chamber 120 without fully extinguishing the flames. This features allows the burner system 104 to burn at less than full capacity, depending on whether the user desires less heat and/or smaller or fewer flames. Even when the shutter 118 is moved to a partial burn position, the shutter 118 may still cover the fill port 144 so that the plug 130 cannot be removed and fuel cannot be introduced.

Figure 10:
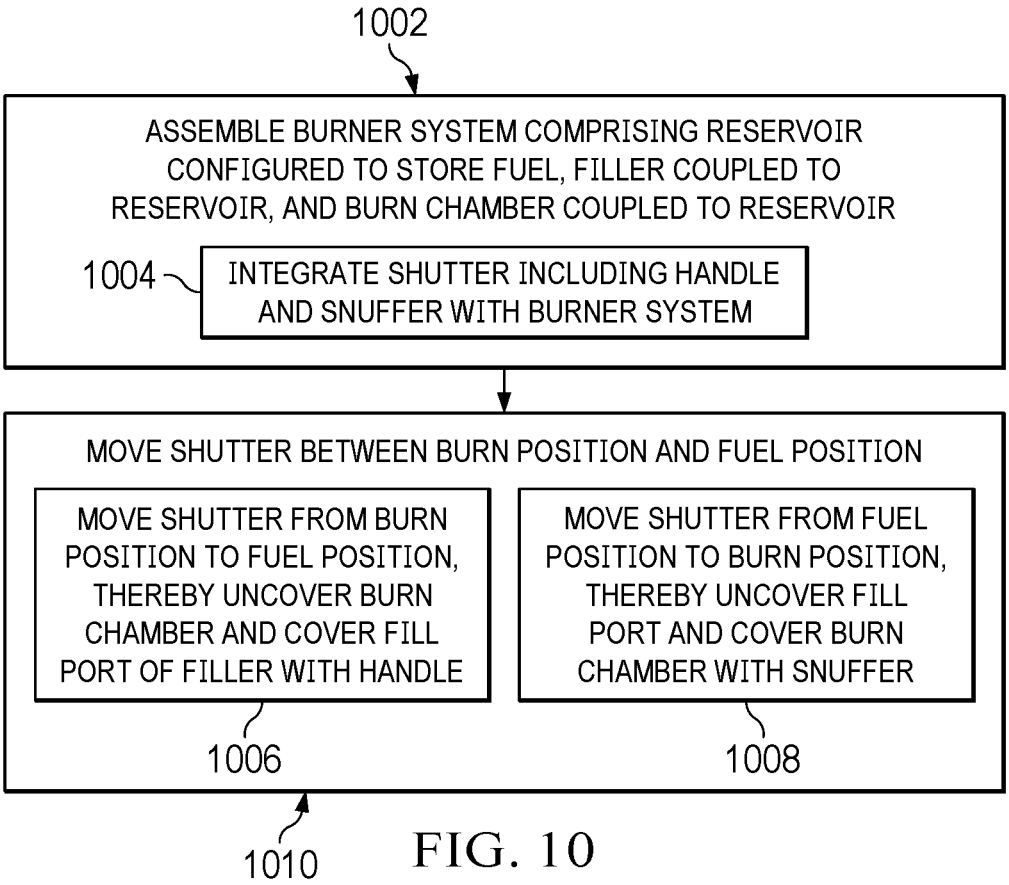
FIG. 10 is a flowchart illustrating a method for operating a burner system, according to examples of the present disclosure.

FIG. 10 is a flowchart illustrating a method for operating a burner system (e.g., the burner system 104), according to examples of the present disclosure. While FIG. 10 shows illustrative operations according to one example, other examples may omit, add to, reorder, and/or modify any of the operations shown in FIG. 10. Furthermore, other methods may incorporate other principles and aspects described throughout this disclosure.

A process 1002, in some examples, includes assembling the burner system 104 comprising the reservoir 124 configured to store fuel, a filler 126 coupled to the reservoir 124, and the burn chamber 120 coupled to the reservoir. In some examples, assembling the burner system 104 includes positioning the base plate 116 at least partially above the reservoir 124 and positioning the shutter 118 between the base plate 116 and the burn chamber 120.

A process 1004, in some examples, includes integrating the shutter 118 including the handle 156 and the snuffer 158 with the burner system 104. By integrating the shutter 118, the shutter 118 is inseparable from the burner system 104. The shutter 118 may be integrated by the method in the ways described above. In some examples, the shutter 118 is integrated with the burner system 104 during the assembly of the burner system 104 in process 1002.

A process 1006, in some examples, includes moving the shutter 118 including the handle 156 and the snuffer 158 between a burn position where the burn chamber 120 is operable to burn fuel stored in the reservoir and a fuel position where the fill port 144 is usable to fill the reservoir 124 with fuel. In some examples, moving the shutter 118 between the burn position and the fuel position includes sliding the handle 156 through the handle opening 176 defined by the base plate 116. As the shutter 118 is moved between the positions, the snuffer 158 may be slid against the lip 159 of the burn chamber 120. The lip 159 acts as a guide to ensure the snuffer 158 is supported and covers the burn opening 154.

A process 1010, in some examples, includes moving the shutter 118 between the burn position and the fuel position including moving the shutter 118 from the burn position to the fuel position. Performing this movement simultaneously uncovers the burn chamber 120 while covering the fill port 144 of the filler 126 with the handle 156. When the shutter 118 is moved from the burn position to the fuel position, the distally-facing stopping surface 182 of the handle 156 may be engaged with the base plate 116 or the reservoir 124 to prevent distal movement of the shutter 118 beyond the fuel position. After the fuel position is reached, the plug 130 can be removed from the filler 126 and/or the fill opening 149 since the fill port 144 and the fill opening 149 are sufficiently uncovered. Once the shutter 118 is moved from the burn position to the fuel position the burner system 104 can be fueled apart from the burn chamber 120, where any combustions remains completely snuffed by the snuffer 158.

A process 1008, in some examples, includes moving the shutter 118 between the burn position and the fuel position includes moving the shutter 118 from the fuel position to the burn position. This movement simultaneously uncovers the fill port 144 while covering the burn chamber 120 with the snuffer 158. When the shutter 118 is moved from the fuel position to the burn position, the proximally-facing stopping surface 186 of the shutter may engage with the base plate 116 or the reservoir 124 to prevent proximal movement of the shutter 118 beyond the burn position. Once the shutter 118 is moved between the fuel position to the burn position the burner system 104 can combust apart from the fill port 144.

Throughout these processes, the shutter 118 may be moved to a partial burn position where the burner system 104 can burn fuel at a rate desired by the user. When the shutter 118 covers only a portion of the burn opening 154, the amount of combustion that occurs is smaller than when the burn opening 154 is fully open. However, the fill port 144 may still remained at least partially covered to prevent the plug 130 from being removed and prevent fuel from being added into the burner system 104.

The methods and operations described above can be applied to the combustion systems and burner systems as described herein. All of the features of the combustion systems and the burner systems may be applicable to the method and may enhance or add additional process to the method.

The methods described herein are illustrated as a set of operations or processes. Not all of the illustrated processes may be performed in all examples of the methods. Additionally, one or more processes that are not expressly illustrated or described may be included before, after, in between, or as part of the example processes. In some examples, one or more of the processes may be performed by a controller and/or may be implemented, at least in part, in the form of executable code stored on non-transitory, tangible, computer or machine-readable media that when run by one or more processors may cause the one or more processors to perform one, some, or all of the processes described in relation to the methods herein. Elements illustrated in block diagrams herein may be implemented with hardware, software, firmware, or any combination thereof. One block element being illustrated separate from another block element does not necessarily require that the functions performed by each separate element requires distinct hardware or software but rather they are illustrated separately for the sake of description.

In some instances, well-known methods, procedures, and components have not been described in detail so as not to unnecessarily obscure aspects of the examples. While certain exemplary examples of the present disclosure have been described and shown in the accompanying drawings, it is to be understood that such examples are merely illustrative of and not restrictive on the broad disclosure herein, and that the examples of the present disclosure should not be limited to the specific constructions and arrangements shown and described, since various other modifications may occur to those ordinarily skilled in the art.

What is claimed is:

1. A burner system comprising:

a reservoir configured to store fuel;

a filler coupled to the reservoir and including a fill port;

a burn chamber coupled to the reservoir; and a shutter including a fill cap and a snuffer, the shutter movable between:

a burn position wherein the burn chamber is operable to burn fuel stored in the reservoir; and a fuel position wherein the fill port is usable to fill the reservoir with fuel, wherein in the fuel position the fill port is uncovered and the suffer covers the burn chamber.

2. The burner system of claim 1, wherein in the burn position the burn chamber is uncovered and the fill cap covers the fill port of the filler.

3. The burner system of claim 1, further comprising a plug disposed at least partially within the filler, and wherein in the burn position the shutter prevents the plug from being removed from the filler.

4. The burner system of claim 1, wherein the shutter is an integrated shutter inseparable from the burner system.

5. The burner system of claim 1, further comprising a base plate positioned above the reservoir, and wherein the shutter is positioned between the base plate and the burn chamber.

6. The burner system of claim 5, wherein the fill cap is a handle configured to slide through a handle opening defined by the base plate during movement between the burn position and the fuel position.

7. The burner system of claim 5, wherein the snuffer slides against a lip of the burn chamber during movement between the burn position and the fuel position.

8. The burner system of claim 5, wherein the fill cap is a handle including a distally-facing stopping surface engageable with the base plate or the reservoir to prevent distal movement of the shutter beyond the burn position.

9. The burner system of claim 5, wherein the snuffer includes a proximally-facing stopping surface engageable with the base plate or the reservoir to prevent proximal movement of the shutter beyond the fuel position.

10. A method for operating a burner system comprising a reservoir configured to store fuel, a filler coupled to the reservoir and including a fill port, and a burn chamber coupled to the reservoir, the method comprising:

moving a shutter including a fill cap and a snuffer between:

a burn position wherein the burn chamber is operable to burn fuel stored in the reservoir; and a fuel position wherein the fill port is usable to fill the reservoir with fuel, wherein moving the shutter between the burn position and the fuel position includes moving the shutter from the fuel position to the burn position, thereby uncovering the burn chamber and covering the fill port of the filler with the fill cap.

11. The method of claim 10, wherein moving the shutter between the burn position and the fuel position includes moving the shutter from the burn position to the fuel position, thereby uncovering the fill port and covering the burn chamber with the snuffer.

12. The method of claim 10, further comprising integrating the shutter with the burner system during assembly of the burner system, wherein the integrated shutter is inseparable from the burner system.

13. The method of claim 12, wherein assembling the burner system includes positioning a base plate above the reservoir and positioning the shutter between the base plate and the burn chamber.

14. The method of claim 13, wherein moving the shutter between the burn position and the fuel position includes sliding the fill cap through an opening defined by the base plate.

15. The method of claim 13, wherein moving the shutter between the burn position and the fuel position includes sliding the snuffer against a lip of the burn chamber.

16. The method of claim 13, wherein moving the shutter between the burn position and the fuel position includes engaging a distally-facing stopping surface of the fill cap with the base plate or the reservoir to prevent distal movement of the shutter beyond the burn position.

17. The method of claim 13, wherein moving the shutter between the burn position and the fuel position includes engaging a proximally-facing stopping surface of the shutter with the base plate or the reservoir to prevent proximal movement of the shutter beyond the fuel position.

18. A burner system comprising:

a reservoir configured to store fuel;

a filler coupled to the reservoir and usable to fill the reservoir with fuel, the filler including a fill port;

a base plate positioned at least partially above the reservoir and defining a fill opening, wherein the fill opening is shaped like a funnel and configured to transfer fuel into the fill port; and a burn chamber coupled to the reservoir and configured to burn fuel stored in the reservoir, wherein the fill port is spaced apart from the burn chamber.

19. The burner system of claim 18, wherein the filler includes a fill line, the fill line configured to introduce fuel into the reservoir through an entrance port in the reservoir, wherein the entrance port is spaced apart from the burn chamber.

20. The burner system of claim 18, further comprising a shield configured to block heat produced at the burn chamber, wherein the shield is positioned at least partially between the burn chamber and the fill port spaced apart from the burn chamber.

21. The burner system of claim 18, wherein the fill port is coupled to the fill opening defined by the base plate.

22. The burner system of claim 21, wherein the fill opening is shaped to funnel fuel into the fill port.

23. The burner system of claim 18, wherein the filler includes a flame arrester configured to prevent flames from spreading from the burn chamber to the fill port of the filler.

24. The burner system of claim 18, wherein the filler includes a one-way valve configured to prevent fuel from flowing from the reservoir towards the fill port.

* * * * *